US005791213A

United States Patent [19]

Young

[11] Patent Number: 5,791,213

[45] Date of Patent: Aug. 11, 1998

[54] PIPE WRENCH STAND

[76] Inventor: John Young, 3705 Artic Blvd. #1882, Anchorage, Ak. 99503

[21] Appl. No.: 747,465

[22] Filed: Nov. 12, 1996

Related U.S. Application Data

[63] Continuation-in-part of Ser. No. 567,686, Dec. 5, 1995, abandoned.

[51] Int. Cl.[6] ..... B25B 23/00

[52] U.S. Cl. ..... 81/462; 269/203; 81/180.1

[58] Field of Search ..... 81/52, 180.1, 462; 269/96, 203; 248/167

[56] References Cited

U.S. PATENT DOCUMENTS

| | | | |
|---|---|---|---|
| 395,661 | 1/1889 | Morgan | 269/203 |
| 1,606,634 | 11/1926 | Hinds | 269/203 X |
| 2,713,802 | 7/1955 | Mittleman | 269/203 |
| 3,320,836 | 5/1967 | Hagerman | 81/180.1 |

*Primary Examiner*—James G. Smith
*Attorney, Agent, or Firm*—Michael Tavella

[57] ABSTRACT

A pipe wrench stand having a flat base, a fixed upright support, an adjustable upright support, and a locking system to lock the adjustable support in the desired position. The pipe wrench stand also has a channel formed in the base, to hold the adjustable support in alignment and a recessed center channel for holding a pipe wrench head. In one embodiment, mounting holes are drilled in the base to mount the device on a work pad or to hang the device for storage. A pipe wrench is supported in the pipe wrench stand to support the pipe wrench during tightening operation with threaded pipes.

12 Claims, 7 Drawing Sheets

PIPE WRENCH STAND

RELATED APPLICATIONS

This is a continuation-in-part of application Ser. No. 08/567,686, filed Dec. 5, 1995, now abandoned.

BACKGROUND OF THE INVENTION

This invention relates to pipe wrench stand and particularly to pipe wrench stands with movable supports.

Plumbers and pipe fitters assemble threaded pipe using large wrenches called pipe wrenches. Often, two wrenches are used to tighten lengths of pipe. One wrench is used as a clamp to prevent rotation of one of the pipe pieces. The second pipe piece is brought up to the first pipe and the threads are engaged. The other wrench then turns the other pipe tightening the threads. For pipes of any size, the clamping wrench is typically placed on the floor and held with a foot. This is not a safe way to operate as the wrench is on edge and is unstable. If the wrench slips during the process, the worker may be injured. At best, the wrenches must be set up again and the process restarted. This takes time and adds to the cost of the job. Several devices have been developed in an attempt to solve this problem as well as for holding pipe wrenches generally. Some examples of these devices are found in U.S. Pat. Nos. 439,918 to Wilkes, 1,065,016 to Anderson, 1,336,755 to Parmelee, and 2,971,411 to Dull. The Wilkes device has a small stand that is secured to a bench using a thumb screw. The wrench is secured in the stand by drilling a hole in the wrench head that accepts a pin formed on the inside of the stand. A second thumb screw is used to secure the wrench further in the stand. The Anderson device is a combination wrench and vice. It has a special holder that clamps to a bench to hold the wrench. The wrench has a ratchet system for advancing the jaws. Thus, the wrench can be used by it self, or, using the bracket, the wrench can be mounted to a workbench. The Parmelee design uses a holder that accepts a specially designed wrench. Using this design, the wrench can be used as a vice. Finally, the Dull design uses a formed stand that has a front slot that holds the wrench body and a rear pipe that holds the wrench tail. A pin secures the wrench in the stand for use. This device is designed to accept a standard pipe wrench.

With the exception of the Dull device, each of these wrench stands requires a specially made wrench to be held, within the stand. These designs are not practical because they do not use standard pipe wrenches. As a result, workers who have many standard wrenches cannot use them with these stands. Since these wrenches are expensive, most workers would not use these devices. Although the Dull device uses standard pipe wrenches, the design is large, heavy, and does not appear able to accommodate a wide variety of pipe wrenches. For example, a 12 inch wrench cannot not fit in a stand to hold a 36 inch wrench. This means workers must have more than one of these supports to be practical. Moreover, operation of this stand requires that the user slide the entire body of the wrench through the front support and then pin the tail in the rear support. This procedure must then be reversed to remove the wrench. This action takes some time, making the operation inefficient.

Referring now to FIGS. 1 and 2, the prior art method of tightening threaded pipes typically uses two pipe wrenches. FIG. 1 shown a pipe wrench 1 resting on a surface 2. A pipe 3 is placed in the jaws 4 of the wrench 1, which are tightened to hold the pipe 3. FIG. 2 shows a second pipe wrench 6 being used with the first pipe wrench 1. This wrench 6 is positioned as shown. The user typically holds the handle 7 of the first pipe wrench 1 to hold the wrench in position. The user then turns the second wrench 6 in the direction of the arrow, to tighten the pipe 3. When the second wrench is fully turned to the right the second wrench 6 is slipped off the pipe 3 and replaced to the first position. Although this method works, it is not safe. The lower pipe wrench 1 often tips over, causing the user to slip. The pipe wrenches 1 and 6 are often heavy. Dropping one can cause injury.

SUMMARY OF THE INVENTION

The present invention overcomes these difficulties. It has a flat base, a fixed upright support, an adjustable upright support, and a means for locking the adjustable support in the desired position. The adjustable upright support rests in a channel to keep it from turning. A recessed center portion is formed between the upright supports. The recessed center portion keep a pipe wrench in place and prevents it from sliding forward or backward when it is held in the supports. In one embodiment, mounting holes are drilled in the base to secure the device to a work pad or to hang the invention for storage.

DETAILED DESCRIPTION OF THE INVENTION

Figure 1:
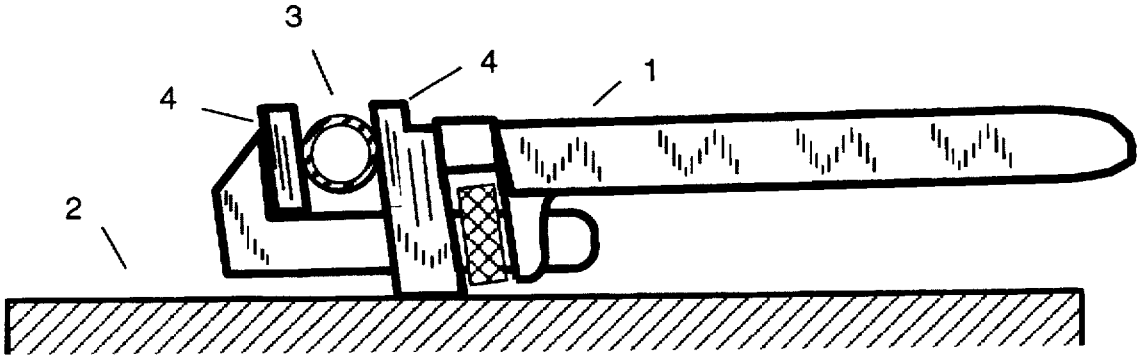
Figure 1 Prior Art
FIG. 1 is a side view of a pipe wrench holding a pipe as prior art.
Figure 2:
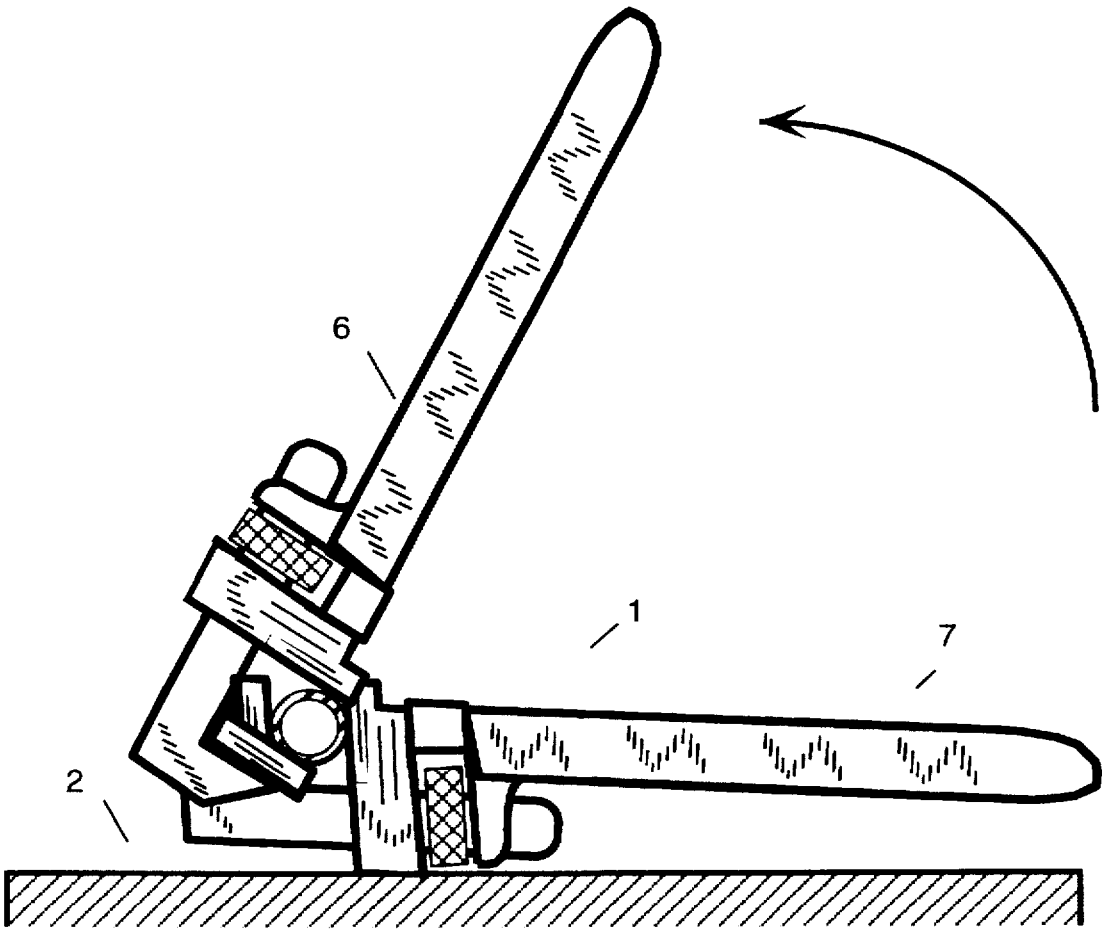
Figure 2 Prior Art
FIG. 2 is a side view of two pipe wrenches holding a pipe, ready to tighten the pipe, as prior art.
Figure 3:
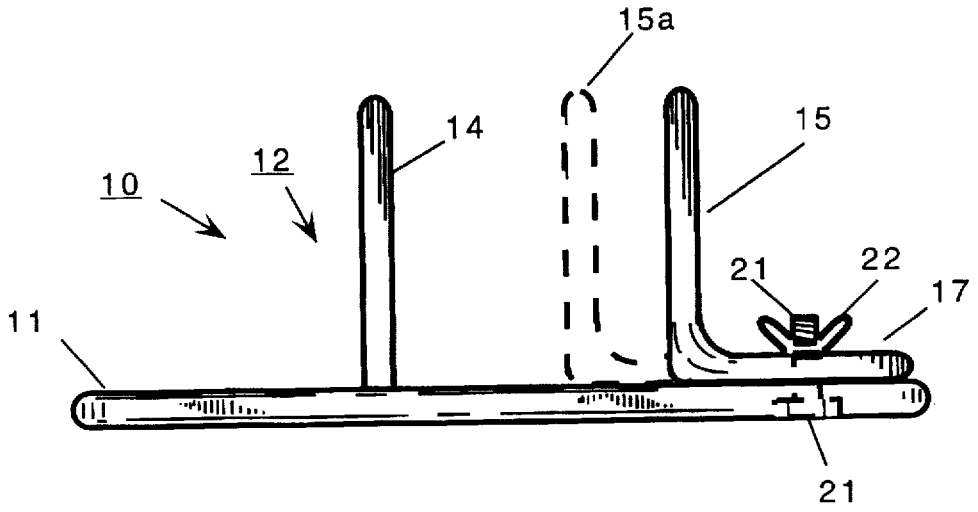
FIG. 3 is a side view of the invention.

Referring to FIGS. 3 through 7, the present invention provides a safe, secure support 10 for a pipe wrench 1 that eliminates the danger of the pipe wrench 1 slipping during the tightening process. The pipe wrench support 10 has a flat base 11. The base 11 is generally rectangular and, in the preferred embodiment, has smooth, curved edges. A fixed vertical support 12 is attached or formed on the base 11 as shown. See FIGS. 4, 5 and 7. The fixed vertical support 12 has a vertical flange 14. The vertical support can be made of angle metal or plastic, if desired, or it can be made from two blocks of material. The fixed vertical support 12 is attached to the base 11 so that it cannot be move.

A second, movable vertical support 15 is provided as shown. See, e.g., FIGS. 4 and 6. In the preferred embodiment, the movable vertical support 15 has the same dimensions and can be made of the same materials as the fixed vertical support 12. The movable vertical support 15, has a slot 16 in a horizontal flange 17 as shown.

Figure 9:
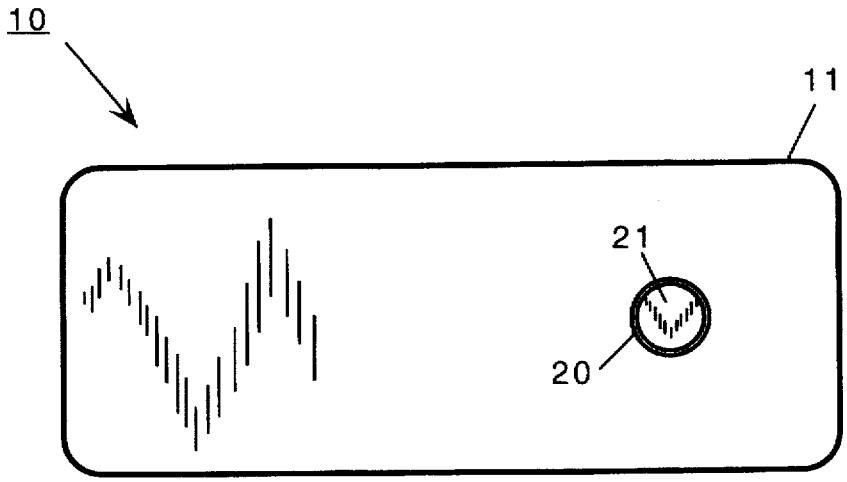
FIG. 9 is a bottom view of the first embodiment.
Figure 10:
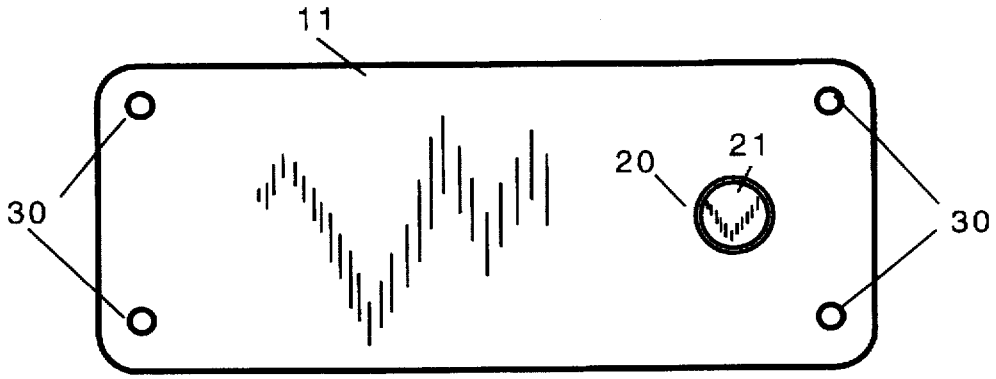
FIG. 10 is a bottom view of the second embodiment.

Referring now to FIGS. 9 and 10, a corresponding hole 20 is formed in the base 11. A bolt, or threaded pin 21 is installed in the base 11 through the hole 20. In the preferred embodiment, this bolt 21 is secured in the base 11 and has no head. In this way, the bolt 21 is flush with the bottom of the base 11 as shown. A wing nut 22 is used to secure the movable vertical support 15 to the base 11. The bolt 21 passes through the slot 16 in the horizontal member 17 of the movable vertical support 15. The wing nut 22 is tightened on the bolt 21 to secure the movable vertical support 15 to the base 11. The slot 16 allows the position of the movable vertical support 15 to be adjusted as needed. See FIG. 3, which shows the movable vertical support 15 in solid line in one position, and then the movable vertical support 15 is shown in dashed line in another position designated as 15*a*.

Referring now to FIGS. 4 through 8, A channel 25 is formed in the base 11 to accommodate the movable vertical support 15. The movable vertical support 15 rests in the channel 25. The channel 25 is used to hold the movable vertical support 15 in linear alignment during use of the device. The channel 25 prevents angular rotation of the horizontal member 17 of the movable vertical support 15. Thus, the channel 25 ensures that the movable vertical support 15 remains in position against the wrench 1 during use.

Figure 4:
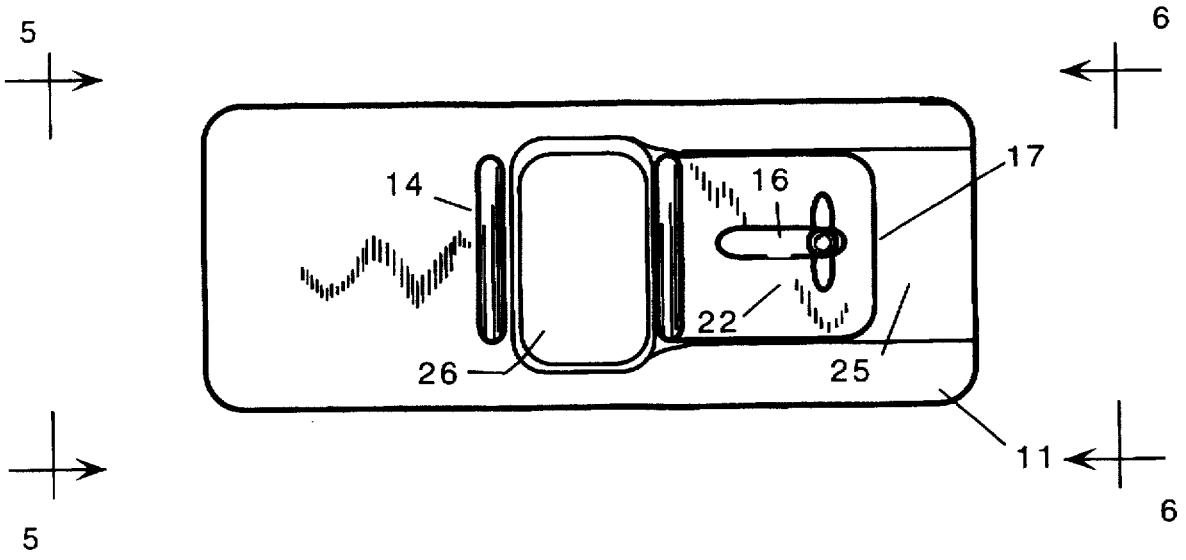
FIG. 4 is a top view of the invention with the movable vertical support in the forward position.
Figure 5:
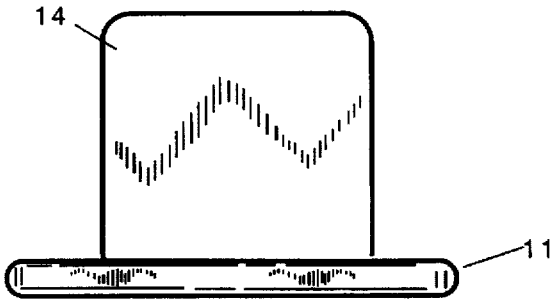
FIG. 5 is an end view of the invention taken along the lines 5—5 of FIG. 4.
Figure 6:
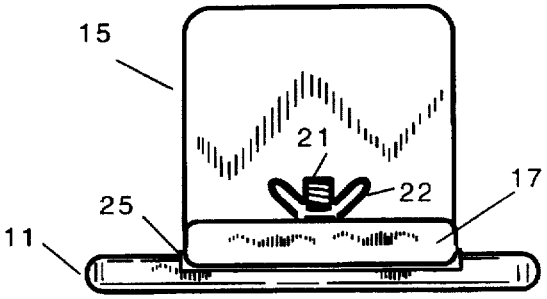
FIG. 6 is an end view of the invention taken along the lines 6—6 of FIG. 4.
Figure 7:
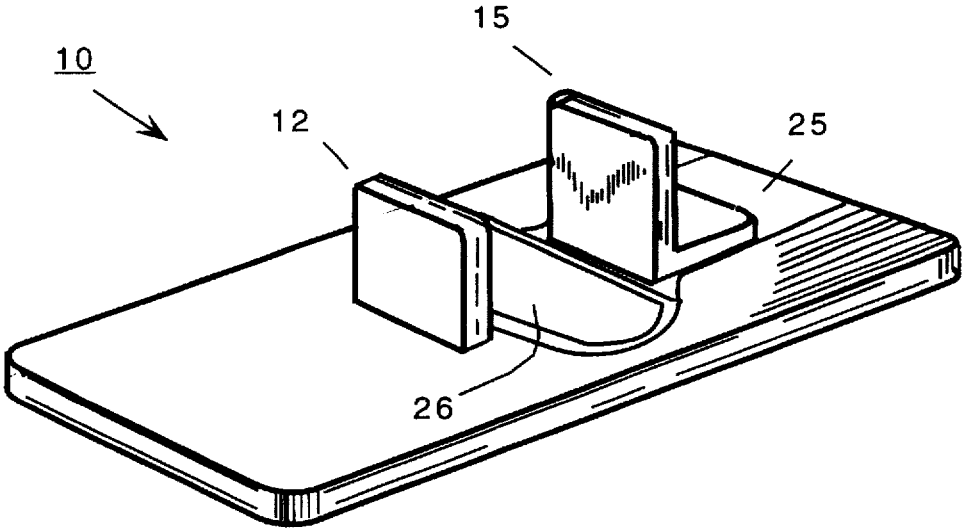
FIG. 7 is a perspective view of the invention.
Figure 8:
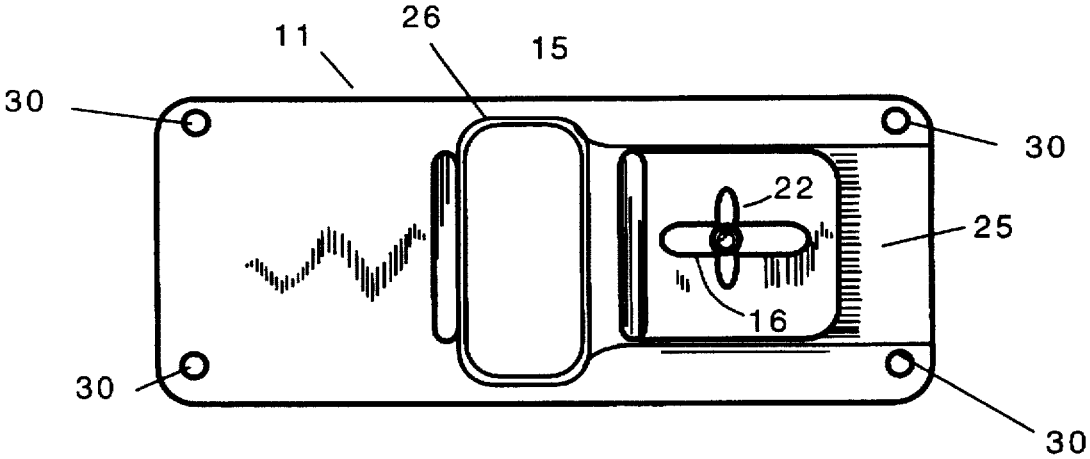
FIG. 8 is a top view of the invention showing the second embodiment of the invention with the movable vertical support in a retracted position.

A recessed center portion 26 is also provided as shown. This recessed center portion 26 holds the head of a wrench 1 and keeps it from sliding forward or backward during use. The recessed portion 26 is formed in the base 11 and can be made during the molding operation or can be cut out once the base has been formed. As shown in FIGS. 4 and 8, the recessed portion 26 can be formed in conjunction with the channel 25.

Referring now to FIGS. 8 and 10, a second embodiment of the invention is shown. In this embodiment, all components are the same except that there are four holes 30 formed in the base 11. The holes 30 can be used to mount the device to a bench, where small pipe wrenches 1 are used, or to mount the base 11 to a truck or other portable stand such as a small board or a piece of plywood (not shown). Moreover, the holes 30 can be used to hang the device from a nail, for example, when it is not in use.

In the preferred embodiment, the device 10 is made of aluminum or high strength plastic.

It is important to remember that the movable vertical support 15 is not used as a vice to firmly hold the wrench 1 (except perhaps for the smallest pipe wrenches). Rather, the device 10 is designed to support the wrench 1 and to prevent it from rolling or tipping during the tightening operation.

Figure 11:
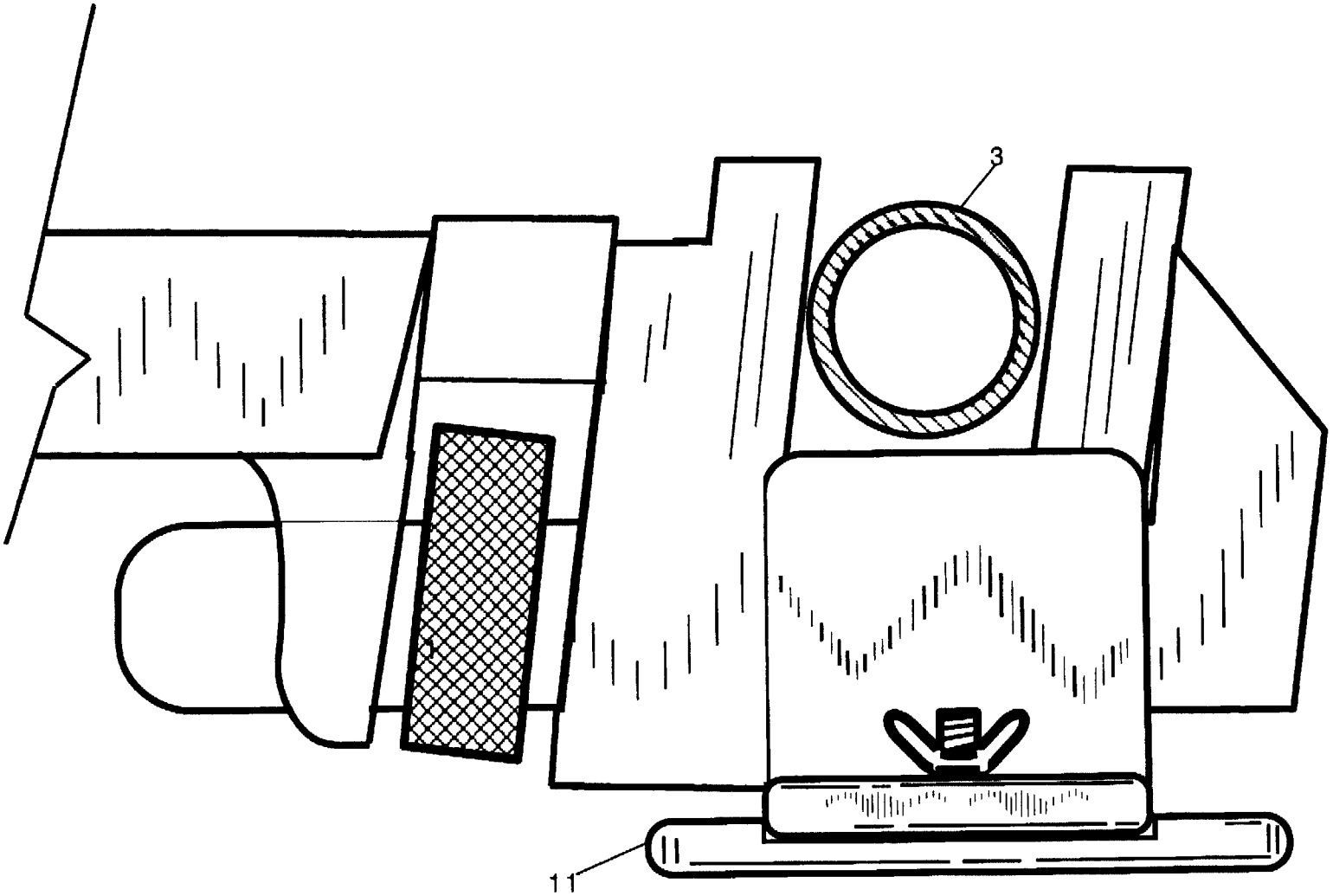
FIG. 11 is a side view of the invention holding a pipe wrench.

FIG. 11 shows a typical pipe wrench 1 in place in the device with a pipe 3 ready to be tightened.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A pipe wrench stand comprising:

a) a base;

b) a stationary vertical member, fixedly attached to the base;

c) a movable vertical member, slidably attached to the base, and having a horizontal flange member extending horizontally therefrom such that the horizontal flange member contacts the base;

d) a means for securing the movable vertical member to the base; and e) a recessed center portion formed in said base and lying between said stationary vertical member and said movable vertical member, such that a pipe wrench placed between the stationary vertical member and the movable vertical member, rests within the recessed center portion.

2. The pipe wrench stand of claim 1 wherein the means for securing the movable vertical member to the base is removably engaged in said horizontal flange member of said movable vertical member.

3. The pipe wrench stand of claim 1 wherein the base is generally rectangular.

4. The pipe wrench stand of claim 1 wherein the stationary vertical member and the movable vertical member are in longitudinal alignment on said base.

5. The pipe wrench stand of claim 1 further comprising a channel, formed within said base and in alignment with said horizontal flange member of said movable vertical member, such that said horizontal flange member sits within said channel.

6. The pipe wrench stand of claim 1 wherein said base has at least one hole formed therein.

7. The pipe wrench stand of claim 1 wherein the means for securing the movable vertical member to the base comprise:

a) a hole, formed in said base;

b) a slot, formed in said horizontal flange member of said movable vertical member, said slot being in relative alignment with said hole; and c) a means for lockably securing said movable vertical member to said base.

8. The pipe wrench stand of claim 7 wherein the means for lockably securing said movable vertical member to said base comprise a bolt, placed through said hole and said slot and being lockably secured therein; and a wing nut, removable placed on said bolt.

9. A pipe wrench stand comprising:

a) a base, said base having a hole formed therein;

b) a stationary vertical member, fixedly attached to the base;

c) a movable vertical member, slidably attached to the base, and having a horizontal flange member extending horizontally therefrom such that the horizontal flange member contacts the base, said horizontal flange member having a slot formed therein such that said slot and said hole in said base are in substantial alignment;

d) a channel, formed within said base and in alignment with said horizontal flange member of said movable vertical member, such that said horizontal flange member sits within said channel;

e) a recessed center portion formed in said base and lying between said stationary vertical member and said movable vertical member, such that a pipe wrench placed between the stationary vertical member and the movable vertical member, rests within the recessed center portion; and f) a means for securing the movable vertical member to the base, whereby the means for securing the movable vertical member to the base is removably engaged in said horizontal flange member of said movable vertical member.

10. The pipe wrench stand of claim 9 wherein the base is generally rectangular.

11. The pipe wrench stand of claim 9 wherein said base has at least one mounting hole formed therein.

12. The pipe wrench stand of claim 9 wherein the means for securing the movable vertical member to the base comprise a bolt and a wing nut, removably placed through said hole in said base and said slot in said horizontal flange member.

* * * * *